US005592194A

United States Patent [19]

Nishikawa

[11] Patent Number: 5,592,194

[45] Date of Patent: Jan. 7, 1997

[54] DISPLAY CONTROLLER

[75] Inventor: Fumitaka Nishikawa, Suwa, Japan

[73] Assignee: Seiko Epson Corporation, Tokyo, Japan

[21] Appl. No.: 461,613

[22] Filed: Jun. 5, 1995

Related U.S. Application Data

[63] Continuation of Ser. No. 289,963, Aug. 12, 1994, which is a continuation of Ser. No. 147,102, Nov. 3, 1993, abandoned, which is a continuation of Ser. No. 449,932, Mar. 11, 1991, abandoned.

[30] Foreign Application Priority Data

Apr. 27, 1988 [JP] Japan ..... 63-104831
Mar. 27, 1989 [JP] Japan ..... 1-74226

[51] Int. Cl.[6] ..... G09G 5/00

[52] U.S. Cl. ..... 345/127; 345/132; 345/133

[58] Field of Search ..... 358/59, 241; 345/127–133

[56] References Cited

U.S. PATENT DOCUMENTS 4,536,856 8/1985 Hiroishi .
4,760,387 7/1988 Ishii et al. ..... 340/716
4,855,728 8/1989 Mano et al. ..... 340/805
4,926,166 5/1990 Fujisawa et al. ..... 340/717
4,990,902 2/1991 Zenda ..... 340/731
4,990,904 2/1991 Zenda ..... 340/771
4,998,100 3/1991 Ishii ..... 340/784

FOREIGN PATENT DOCUMENTS 58-59490 4/1983 Japan .
59-22585 7/1984 Japan .
2237713 5/1991 United Kingdom .
89/10609 11/1989 WIPO .

OTHER PUBLICATIONS

Mueller, Scott; Upgrading and Repairing PCs, Que Corporation, 1988, "Video Graphics Array", pp. 442–443.
Motorola Semiconductors, Advance Information, "CRT Controller (CRTC)", 1991, pp. 642, 648–650.

*Primary Examiner*—Ulysses Weldon
*Attorney, Agent, or Firm*—Eric B. Janofsky

[57] ABSTRACT

A display controller for controlling the display area used by data on a display unit, having a first setting element that sets a first display size for the display unit, a second setting element that sets a second display size to be used for displaying data, and a control element for outputting display data to the display unit in an area defined by the first and second setting elements whereby data of an equal or lower display resolution is mapped onto the display unit.

25 Claims, 5 Drawing Sheets

DISPLAY CONTROLLER

This is a continuation of application Ser. No. 08/289,963, filed Aug. 12, 1994, which is a continuation of application Ser. No. 08/147,102, filed Nov. 3, 1993, (now abandoned), which is a continuation of application Ser. No. 07/449,932, filed Mar. 11, 1991, now abandoned.

FIELD OF THE INVENTION

The present invention relates to display controllers which generate a display control signals for a flat display panel (such as LCD, plasma display, etc.) to be used for computer systems.

BACKGROUND OF THE INVENTION

In a conventional display controller, a display area setting element is limited to only to one setting method. For example, in case a flat display panel having a size of 640 dots (horizontal direction) 400 dots (vertical direction) is used, the display area (display size) of controller is set to 640×400 dots, while in case a flat display of 640 dots (horizontal direction) by 200 dots (vertical direction) in size is used, the display area of the controller is changed to 640×200 dots. Therefore, in case a plurality of display areas are used in one system; namely in case two kinds of display areas such as the in sizes of 640×400 and 640×200 dots are provided, two different kinds of flat displays are prepared and the display hardware corresponding to the desired display mode is selected.

Since a conventional display controller employs only one kind of display area setting element, if only one display area is prepared or desired in one system, no problem occurs but in case many kinds of display areas are used depending on the software in one system, the display hardware used must be selected to correspond to the software output. Namely, many different types of software cannot be displayed on a single display. For example, in the case of a personal computer IBM-PC type as manufactured by IBM, a plurality of display areas such as 640×350 dots or 640×200 dots, etc. are prepared electronically available for use in the system. Since the display area is selected by the software, if the display hardware is fixed to say, 640×350 dots, software which supports only the display of 640×200 dots can no longer be used by the system.

It is therefore an object of the present invention to solve a problem that exists when a plurality of display areas cannot be displayed on only one display unit by a mode setting method of display controller in order to widen the application field even if the display areas change.

DISCLOSURE OF THE INVENTION

The display controller of the present invention provides a means for independently setting the maximum display capacity a (first display size) of the display and the actual portion of the display used area (second display size).

Since the present invention has a structure described above, display is possible, even when the actual display area (second display size) is smaller than the display capacity (first display size), by independently setting them. Therefore, even when several display areas are prepared, many display areas may be displayed using a single display capacity by setting the respective corresponding values for the display areas.

PREFERRED EMBODIMENT OF THE INVENTION

Figure 1:
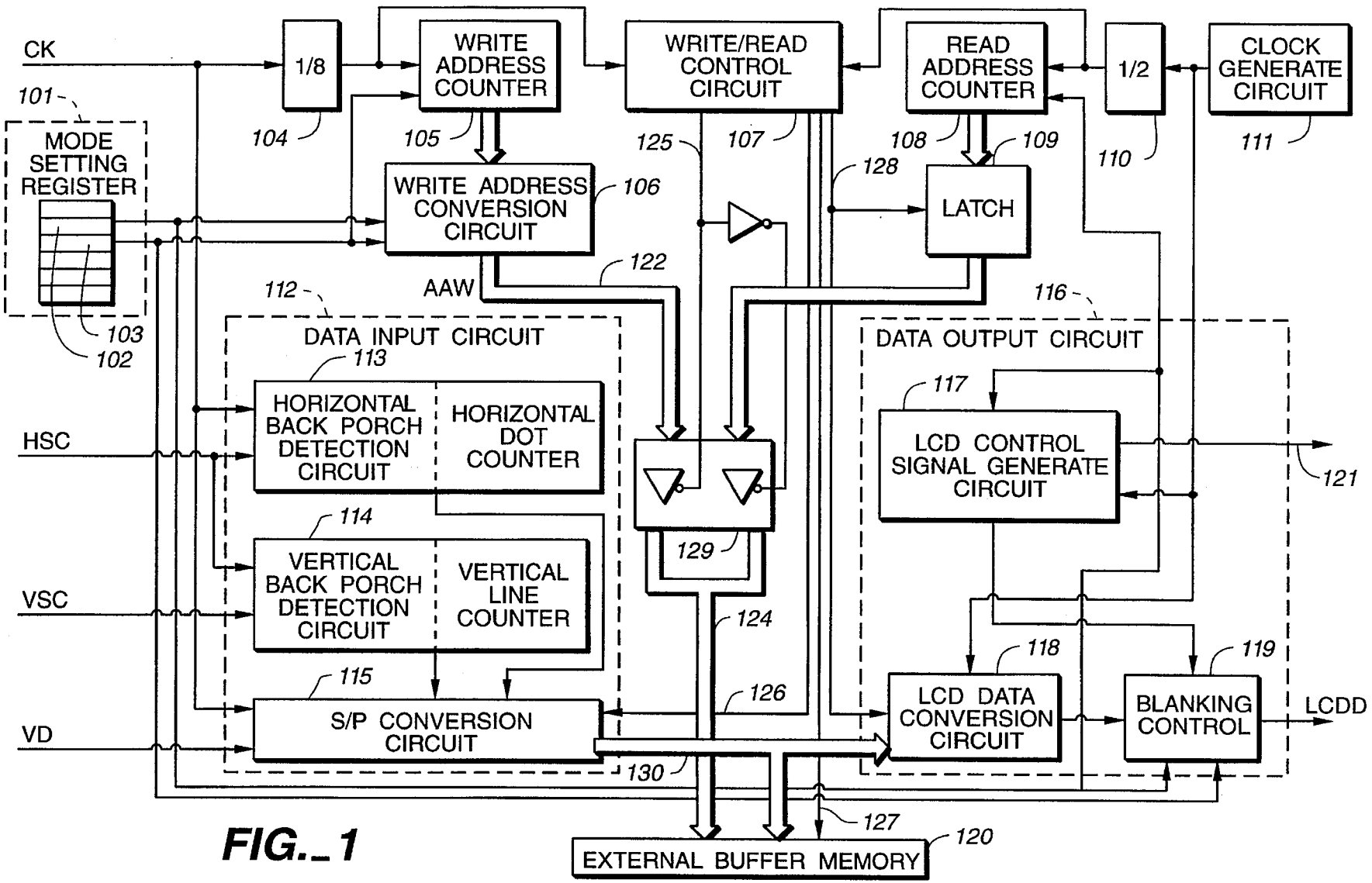
FIG. 1 illustrates an embodiment of a the present invention.

An example of applying the present invention to an LCD controller (hereinafter referred to as video—LCD interface) which converts a video signal for a CRT type displayed into a signal for a liquid crystal display device (LCD) is shown in FIG. 1. Operation of this type of controller are explained in further detail hereunder.

Figure 2:
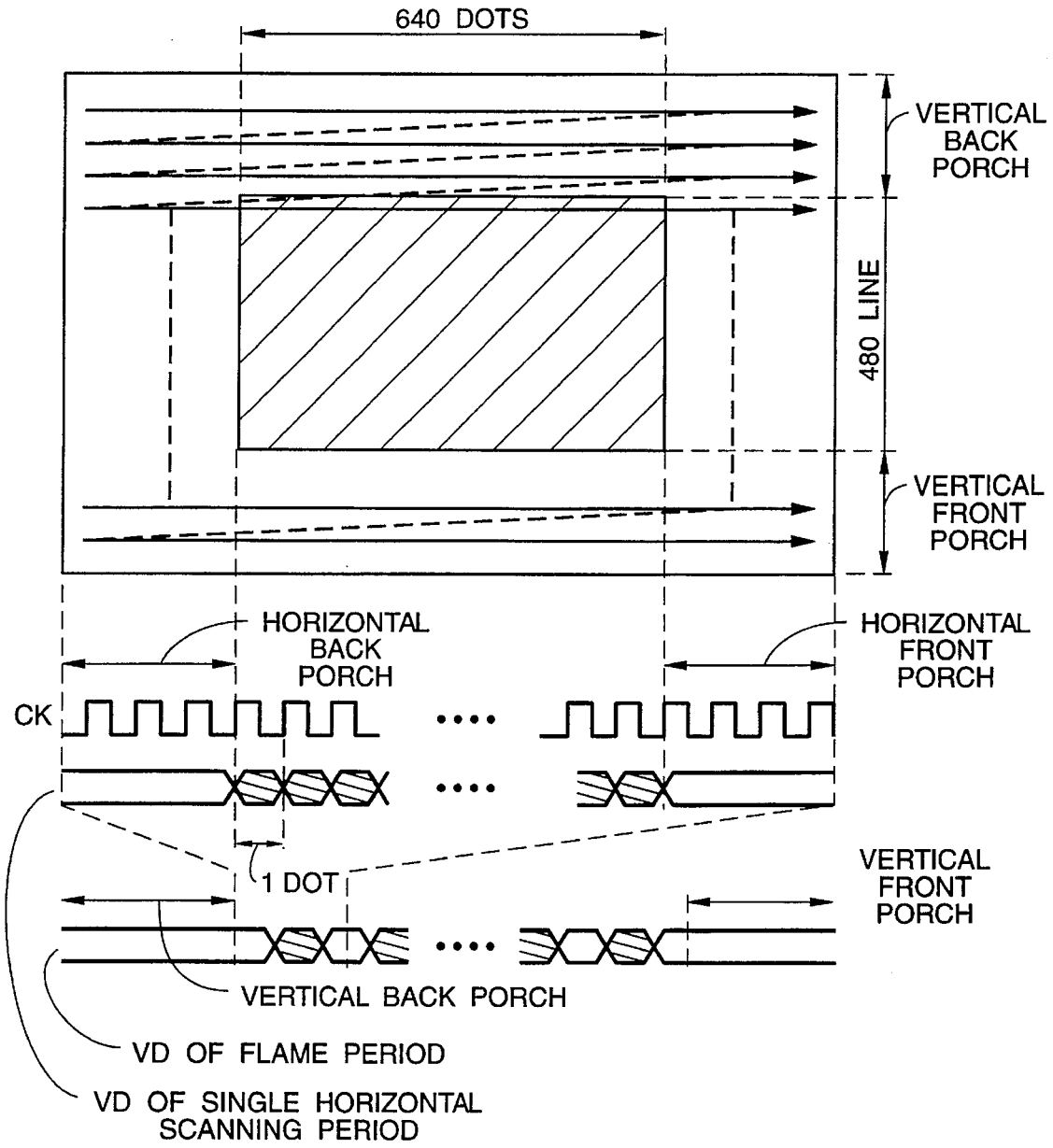
FIG. 2 represents a format of video data signal VD.
Figure 3:
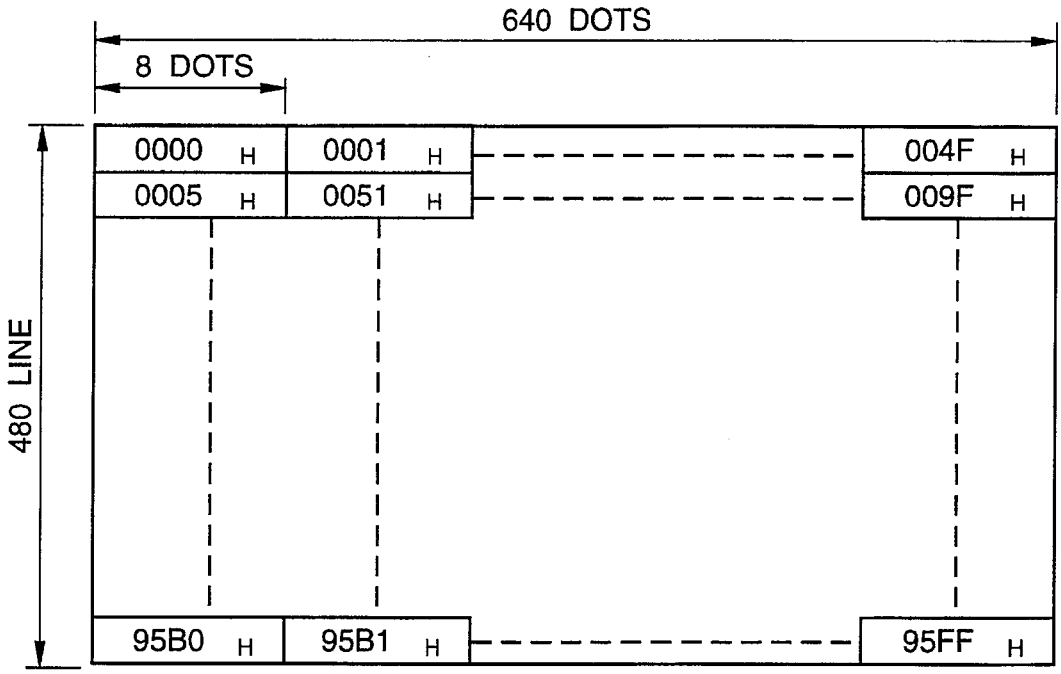
FIG. 3 indicates the correspondence between external buffer memory addresses and display positions.

The video data signal VD and for a CRT generally includes the display data period (hatched area) and the fly back period (outside the hatched area) as shown in FIG. 2. The fly back period can further be classified into four kinds of periods vertical back porch, vertical front porch, horizontal back porch and horizontal front porch. The video data is sequentially scanned from the left upper point of a display and input along the VD bus of FIG. 1 in serial and is fetched by a serial/parallel conversion circuit (hereinafter referred to as S/P conversion circuit) 115 which uses the dot clock signal which is synchronized with VD. This serial data is converted to parallel data in units of 8 bits for ease of writing the data into an external buffer memory 120 through a data bus 130. In this case, the write address is sequentially counted up every 8 bits from the upper left as shown in FIG. 3 and is then output by the write address counter 105 which counts up the write clock 131 which has a frequency that is reduced to an eighth of that of the dot clock CK by a frequency divider 104. The write address AW is switched in or selected every 8 dots and is then output to a write address bus 122 through a write address conversion circuit 106. A read/write control circuit 107 outputs an address switching signal 125 and, write control signals 126, 127 in synchronization with the rising and falling edges of the write clock 131. The address switching circuit 129 outputs one address of the write address 122 and read address 123 to an address bus 124 by an address switching signal 125. Accordingly, in the write operation, when the write address is switched in every 8 dots of the dot clock CK, the write address is output to the bus 124 at the former half of the write clock 131, the parallel data of 8 bits is input in synchronization with the control signal 125 from the S/P conversion circuit 115, the external buffer memory 120 is caused to enter the write mode in response to the control signal 127 and the parallel format data is then written to an address in memory 120 depending on the address data of bus 124.

Since the video data includes invalid data (fly back period) as described previously, control is carried out by a horizontal back porch decision circuit/horizontal dot counter 113, and vertical back porch decision circuit/vertical line counter 114 so that the S/P conversion circuit transfers only the desired display data neglecting such invalid data. A horizontal synchronous signal HSC is input as a counter start pulse and the dot clock CK as the counter clock to the horizontal back porch decision circuit/horizontal dot counter 113. A vertical synchronous signal VSC is likewise input as a counter start pulse and the horizontal synchronous signal HSC as the counter clock to the vertical back porch decision circuit/vertical line counter 14.

Next follows an explanation of operations, read from the external buffer memory. A basic clock for read operations is output from the clock generating circuit 111. A read address counter 108 counts on the read clock 132 signal which is obtained by dividing the frequency of the basic clock for read operations by two using a frequency divider 110 in the sequence fitted to LCD and generates the appropriate read addresses. The data read from external buffer memory 120 is input to a LCD data conversion circuit 118 through the data bus 130, converted to the format fitted to, or required by, the LCD and is then output through a blanking control 119 (described later). Moreover, the control signals (data shift clock, data latch pulse, etc.) required for the LCD are generated by an LCD control signal generating circuit 117 which counts up the clock pulses sent from the clock generating circuit 111 and then supplies them the LCD. During the read operation, a control signal 128 is output from the read/write control circuit 107 and the external buffer memory 120 is set to the read mode by the control signal 127. A counter signal 128 is output in synchronization with the write clock 131 when the read address counter 108 counts up the read clock 132 and the address readout has changed. With this signal 128, a latch 109 latches the read address and outputs such address data to the bus 123. During the read cycle immediately after the read address has changed, the address switching circuit 129 outputs the address data read out and data is read from the address of memory depending on this address data. Described above is an outline of the video-LCD interface.

Figure 4:
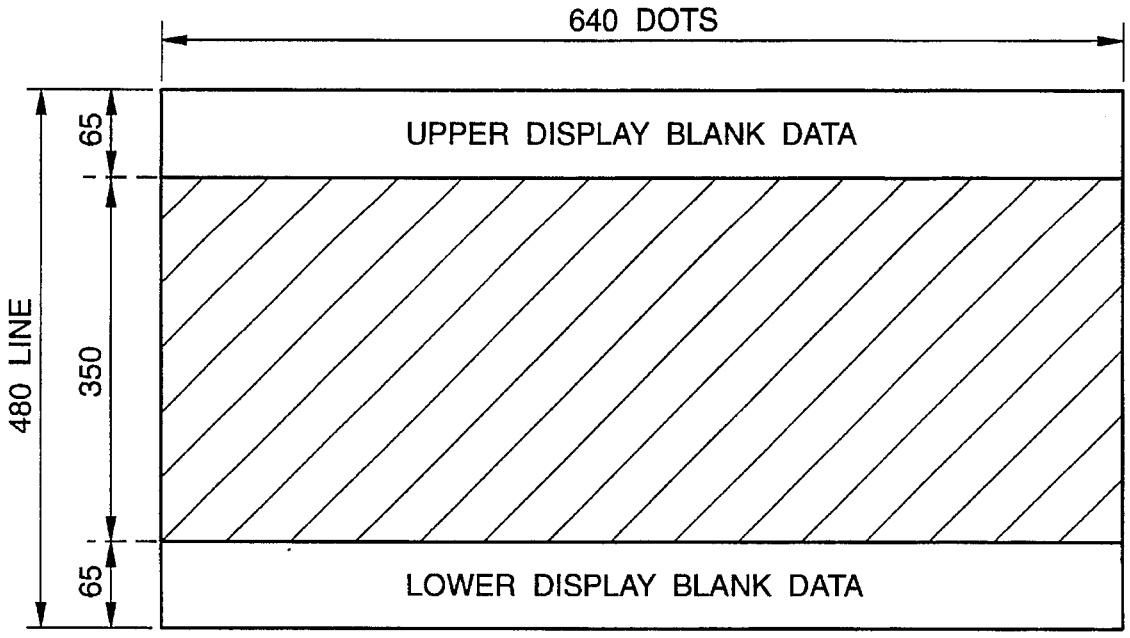
FIG. 4 illustrates an example of an LCD display.
Figure 5:
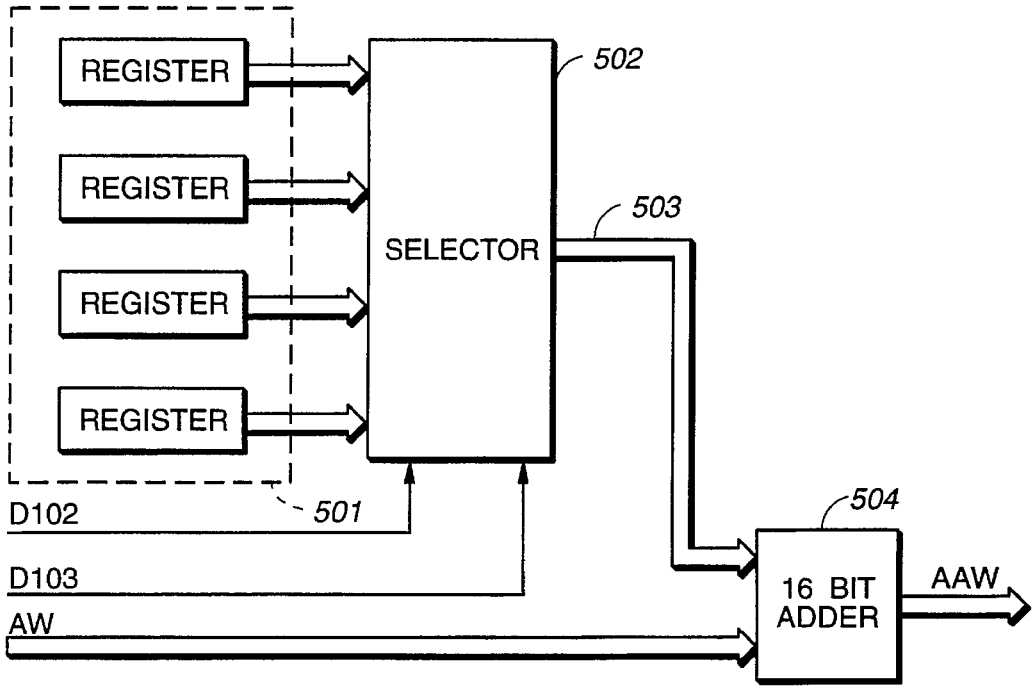
FIG. 5 is a practical example of a write address conversion circuit.

Next, a circuit using the present invention will be explained in detail. First, a mode setting register 101 forms a register group for setting the drive system of the LCD and display area etc., including independently a register 102 for setting the maximum display capacity (first display size) of LCD and a register 103 for setting the actually used display area (second display size) for a video signal. For example, when the display is carried out in a display area of 640×350 dots (for example, EGA mode of personal computer IBM-PC manufactured by IBM) in a LCD having a capacity 640×480 dot matrix, 640×480 dots are set in the register 102 and 640×350 dots are set in the register 103. In this case, display is carried out as shown in FIG. 4 and the buffer memory corresponding to the display capacity (640×480 dots) can be acquired. Here, since the video data (hatched area) only has as many as 350 lines effective, it is necessary to give an offset to the address for writing data to the buffer memory in order to realize the display as shown in FIG. 4. Such a conversion is carried out by a write address conversion circuit 106. The maximum count number counted is sent to a write address counter 105 by D103 indicating the display area. In the case of the display shown in FIG. 4, it is enough to add an address corresponding to the blank data of the upper display screen area or, $$(640 \text{ dots} \times 65 \text{ lines})/8 = 5200 \text{ bytes}$$

as the offset. The circuit for adding such an offset using an adder is shown in FIG. 5 as an example of this circuit.

Here, an offset address register 501 has the written offset value of the address described above. Since several offset values are necessary depending on the combination of display capacity and display area, a plurality of registers are prepared. Only one value is selected through a selector 502 from such registers. In this case, the selector 502 conducts selection based on the output signals D102 and D103 from the mode setting register of FIG. 1. The offset value of 16 bits, selected as explained above, is output to bus 503 and is then input to an adder 504, of 16 bits, together with the output WA from the write address counter 105. As a result, an address corresponding to adding the offset address to the ordinary write address AW is obtained from the output AAW. Namely, since the write address counter 105 only counts the value as being 640 dots×350 lines for the count value set by the signal D103, the address conversion circuit 106 adds the blank area for 640 dots×65 lines to the address AW. Therefore, the input video data is not stored in the buffer memory 120 for the first 5200 bytes of storage addressed and is stored in the successive addresses. When contents of mode setting registers 102, 103 are changed, the maximum count value of write address counter 105 and the offset value of address conversion circuit 106 also change. Therefore, various display areas can be set for the display having various display capacities.

Figure 6:
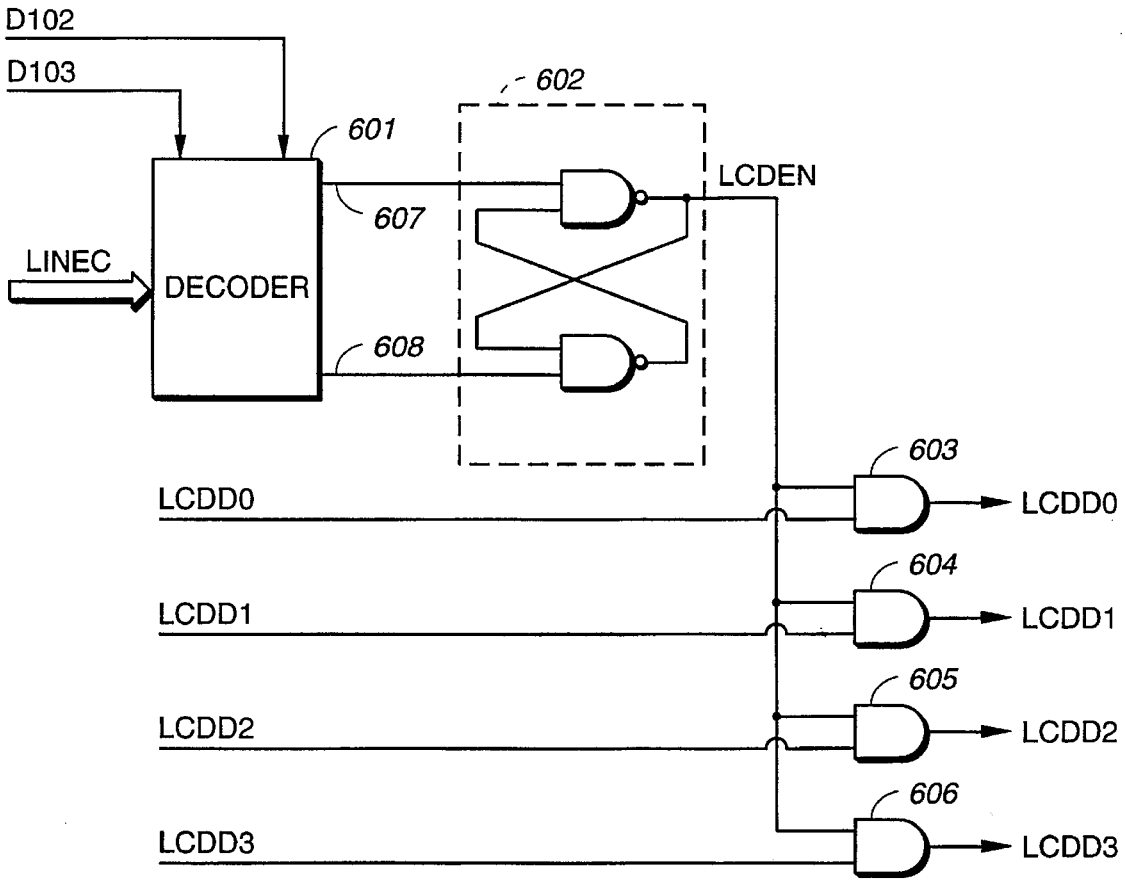
FIG. 6 illustrates a practical example of a blanking control.
Figure 7:
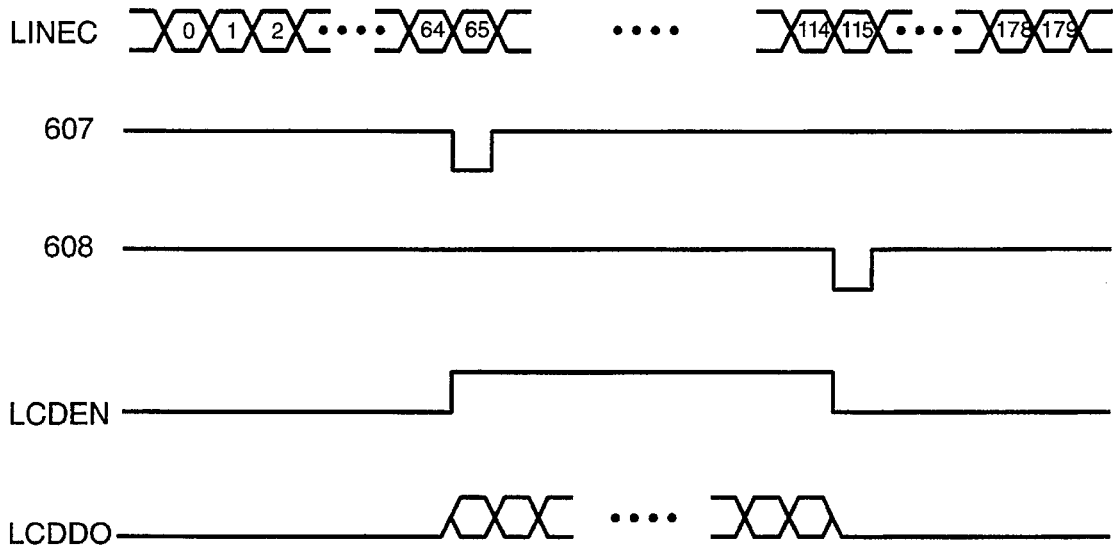
FIG. 7 is a timing chart for the operation of the blanking control FIG. 6.

When writing is conducted with this method, writing is not carried out to the buffer memory of the part corresponding to the blank data shown in FIG. 4 and the valid video data is written from the address next to that of an offset. On the other hand, since read operation is carried out for an entire part of the display capacity, namely of 640×480 dots, read operation is also carried out to the buffer memory to which any data is not written as described above and data transfer to LCD is carried out. Accordingly, if read operation is carried out and data is transferred to LCD, unwanted data is probably displayed in some cases to the upper and lower blank data areas. In order to avoid such an event, the contents of buffer memory is once cleared (when the power switch is turned ON) by preparing the memory clear sequence or also control must be done so that data is not transferred to LCD for the blanking data. The component which executes the latter control is prepared as the blanking control 119. This function disables data output to the LCD corresponding to the blanking data on the basis of information in register 102 and register 103. In this case, data output is disabled (fixed to a low level) during data transfer from the 1st line to 56th line and data transfer from the 416th line to 480th line. An example of a blanking control circuit is shown in FIG. 6. Operations of this circuit will be briefly explained hereunder. The input signal LINEC is an output signal from a line counter of 9 bits of LCD. This LCD line counter is comprised in the LCD control signal generating circuit 117 of FIG. 1 and provided as a 9-bit counter to count up the number of lines of LCD (480 lines in this case). This counter output LINEC is input to a decoder 601 in the blanking control 119. This decoder receives contents D102 and D103 of the mode registers 102 and 103 and switches the decoder output. Here, based on the signals D102 and D103, the decoder outputs a signal 607 by decoding the signal LINEC which indicates the content of the 65th line from which the display area starts and also outputs a signal 608 by decoding the signal LINEC indicating the 415th line from which the display area comes to the end and the blanking data starts. A timing chart for those signals is shown in FIG. 7. These signals are further input to the R/S flip-flop 602 to generate the enable signal LCDEN of LCD data. Only when LCDEN is in a high level state is LCD data enabled and the LCD data LCDD output from the LCD data conversion circuit 118 is output to the LCD through the respective AND gates 603 to 606. In other cases, the outputs of AND gates 603 to 606 are fixed to a low level and are not displayed on the LCD. It should be noted here that the maximum count value is set for the read address counter 108 and the line counter in the LCD control signal generating circuit 117 by the signal D102 which indicates the display capacity of the LCD. Therefore, the read address counter 108 counts up the addresses to repeatedly read the data indicating LCD display capacity from the buffer memory 120. Moreover, the line counter repeats the counting for 480 lines as shown in FIG. 7. Based on the output of this line counter, the enable signal LCDEN is output for the 350 lines from the 65th line to the 414th line during the count value of 480 lines. Therefore, the count value of these counters changes depending on changes in the signals D102 and D103 and various display areas may be set for display of various display capacities an resolutions.

In summary, the display controller of FIG. 1 defines the storage capacity corresponding to the display capacity of the display unit in the buffer memory 120 and in the writing operation does not store video data for the storing capacity of 640 dots×65 lines but stores the data for 640 dots×350 lines from the next address. Accordingly, display is realized in the preset display area by reading data from the addresses of display capacity and then displaying such data. But, in case data only is read, if erroneous data is stored in the address in the buffer memory not storing the video data, erroneous display occurs. In the present invention, however, since data is output to the display unit only during the period of scanning a desired display area by detecting the display position for display and data is set to a fixed level not allowing display during other periods, display is not carried out erroneously in the area outside a preset display area.

Figure 8:
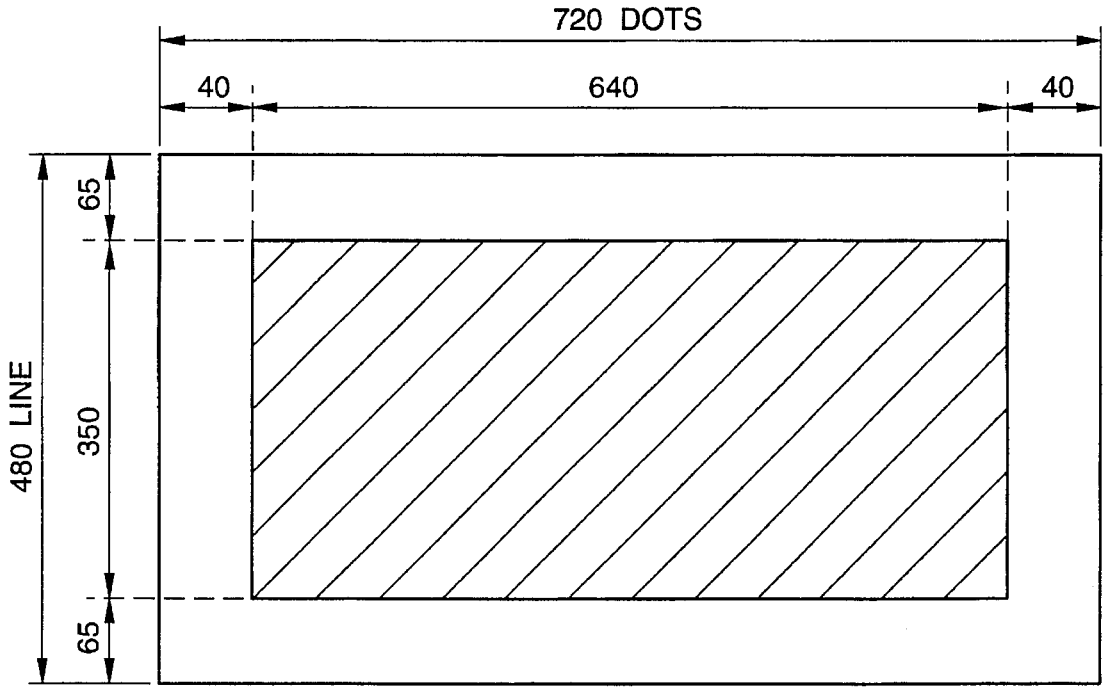
FIG. 8 illustrates an LCD display example having blank data displayed in the upper and lower, right and left sides.

As explained above, display in the area outside the desired display area can be blanked off perfectly. Operations for display of 640×350 dots of data on an LCD of 640×480 dots capacity have been described above. If it is requested here to carry out the display of 640×200 dots, only changing the content of register 103 for setting the display area is required for 640×200 dots. Thereby, the address offset 503 of write address conversion circuit 106 and output of decoder 601 of blanking control 119 are also changed automatically and the display as shown in FIG. 8 can be obtained.

According to the present invention described previously, the register 102 for setting display capacity and the register 103 for setting display area are provided independently. Therefore, various .displays such as 640×350 dots and 640×200 dots, as well as 640×480 dots can be presented on the one LCD, for example, an LCD having a display capacity of 640×480 dots only by changing a value in register 103 without changing display hardware. In the embodiment of the present invention, a register which is a storage means ensuring random access for read and write operation has been used as a means for setting display capacity and display area but other means can also be used in place of this register. For example, the input terminals are provided for simplification to respective elements and setting may be changed by changing input signals to these terminals. In this explanation, the blanking areas are located in the upper and lower portions as shown in FIG. 4 but this explanation can also be applied to the case where the blanking areas exist in the upper and lower, right and left areas as shown in FIG. 8. In the latter case, only little modifications are necessary to the offset address selector 501 in the write address conversion circuit and decoder 601 in the blanking control. Moreover, an LCD has been considered for explanation but controllers for other flat displays (plasma display, for example) can also be used.

The present invention also realizes the display of various display modes (display areas) with only one unit of display. Therefore, it is no longer necessary to change the hardware (display) for each change of display mode by the software and the display can keep up with various software. It is particularly effective to apply the present invention to a lap top computer utilizing a flat display panel because a single kind of flat display can be flexibly used for various software.

What is claimed is:

1. A display controller for controlling the display of data represented as $H_d$ horizontal dots and $V_d$ vertical dots and having a predetermined number of dots defining a predetermined resolution on a display unit, comprising:

first setting means for storing a predetermined maximum usable first display size for the display unit corresponding to a maximum number of horizontal and vertical display dots that can be physically displayed thereon;

second setting means for storing a second display size to be used for displaying data as a desired number of horizontal and vertical dots, said second size being less than the .predetermined maximum;

a buffer memory for storing image data to be displayed of said display unit;

a display counter having a count value that indicates display positions on said display unit;

control means responsive to said first and second setting means and said buffer memory, for generating blanking data and for selectively outputting to said display unit one of (1) all of said display data in said buffer memory through application of address and read and write signals so as to display data covering said second display size in a desired display area of the display unit as defined by a relationship between the specified number of horizontal and vertical dots for said first and second display sizes relative to each other, said display data being displayed with the predetermined number of dots at the predetermined resolution, (2) the blanking data in accordance with the count value for displaying of said blanking data in a display portion outside of the desired display area, wherein said control means reads said display data from addresses in said buffer memory and comprises a read address counter configured to select addresses from which display data is read by said control means, and wherein said display counter comprises a line counter configured for counting and indicating a number of lines on said display and setting a maximum number of lines to be counted from said first display size for said display unit, wherein said control means comprises blanking control means comprising means for generating a display enable signal during a period of time in which lines starting from a display start line of said desired display area and extending to a desired display end line are counted and indicated by the contents of said line counter; and gate means for outputting said display data read from said buffer memory addresses designated by said read address counter, which sets a maximum count value based on said first display size to said display unit during the period said display enable signal is generated.

2. A display controller for controlling the display of data represented as $H_d$ horizontal dots and $V_d$ vertical dots and having a predetermined number of dots defining a predetermined resolution on a display unit, comprising:

first setting means for storing a predetermined maximum usable first display size for the display unit corresponding to a maximum number of horizontal and vertical display dots that can be physically displayed thereon;

second setting means for storing a second display size to be used for displaying data as a desired number of horizontal and vertical dots, said second size being less than the predetermined maximum;

a buffer memory for storing image data to be displayed on said display unit;

a display counter having a count value that indicates display positions on said display unit; and control means responsive to said first and second setting means and said buffer memory, for generating blanking data and for selectively outputting to said display unit one of (1) all of said display data in said buffer memory through application of address and read and write signals so as to display data covering said second display size in a desired display area of the display unit as defined by a relationship between the specified number of horizontal and vertical dots for said first and second display sizes relative to each other, said display data being displayed with the predetermined number of dots at the predetermined resolution, (2) the blanking data in accordance with the count value for display of said blanking data in a display portion outside of said desired display area.

3. A display controller according to claim 2, wherein said control means reads said display data from addresses in said buffer memory and comprises a read address counter configured to select addresses from which display data is read by said control means.

4. A display controller according to claim 3, wherein said control means further comprises a write address counter configured to count a clock signal synchronized with said display data and set a maximum count value based on values for said second display size, said read address counter sets a maximum count value based on said first display size, and address conversion means for converting an output of said write address counter to offset adjusted address values used by said control means to write said display data to memory addresses corresponding to said desired display area and not to memory addresses corresponding to an area other than said desired display area.

5. A display controller according to claim 4, wherein said address conversion means generates address data by offsetting the addresses before addressing of said buffer memory corresponding to the display start position of said desired display area, and then adds such addresses to the output of said write address counter.

6. A display controller according the claim 4, wherein said read address counter designates an address of said buffer memory to read the data corresponding to a first display size of said display unit and said write address counter designates an address of said buffer memory to write said display data to corresponding to said display area in the address read from said buffer memory.

7. A display controller according to claim 6, wherein said display data written into said buffer memory is video data and said display data output from said control means is data configured for display on liquid crystal or plasma display units.

8. A display controller according to claim 6, wherein said first and second setting means are formed by a read/write memory.

9. The display controller of claim 3 wherein a first display area comprises an area defined by said first display size being $H_{max}$ horizontal dots by $V_{max}$ vertical dots, each being an integer value; and a second display area comprises an area defined by said second display size being $H_d$ horizontal dots by $V_d$ vertical dots, each being an integer value, wherein $H_d \leqq H_{max}$, $V_d \leqq V_{max}$ and said desired display area is a portion of or equal to the first display area as determined by the relationship of $H_d$ to $H_{max}$ and of $V_d$ to $V_{max}$.

10. The display controller of claim 9 wherein said blanking control means further comprises:

offset means for selecting predetermined horizontal and vertical display offset positions $H_m$ and $V_m$ as integers numbers of dots for said data to be displayed relative to a preselected starting position in said first display area, wherein $0 \leqq H_m$ and $0 \leqq V_m$ and for displaying data in an area of said display unit in an area defined by coordinates $(H_m, V_m)$, $(H_m+H_d, V_m)$, $(H_m, V_m+V_d)$, $(H_m+H_d, V_m+V_d)$ and for otherwise blanking a remaining area of said display unit.

11. The display controller of claim 10 wherein said blanking control means comprises:

first blanking means for blanking said display over an area bounded by the display positions ranging between 0 to $H_{max}$ in a horizontal direction and between 0 to $V_m$ dots in the vertical direction;

second blanking means for blanking said display positions where the horizontal position ranges between 0 to $H_m$ and the vertical between $V_m$ and $(V_d+V_m)$ dots;

third blanking means for blanking said display positions where the horizontal position ranges between $(H_m+H_d)$ and $H_{max}$ and the vertical between $V_m$ and $(V_d+V_m)$ dots; and fourth blanking means for blanking said display for display positions where the horizontal position ranges between 0 and $H_{max}$ and the vertical between $(V_d+V_m)$ and $V_{max}$ dots.

12. The display controller of claim 1 wherein $H_m$ ranges between 0 and a predetermined value less than or equal to $H_{max}-H_d$ and $V_m$ ranges between 0 and a predetermined value less than or equal to $V_{max}-V_d$.

13. The display controller of claim 11 wherein $H_m$ is equal to $(H_{max}-H_d)/2$.

14. The display controller of claim 11 wherein $V_m$ is equal to $(V_{max}-V_d)/2$.

15. The display controller of claim 11 where Vm and Hm are preselected, desired, offsets for the display of data.

16. The display controller of claim 11 wherein said first, second, third, and fourth blanking means comprise a single blanking controller.

17. A display controller according to claim 6, wherein said first and second setting means comprise a register file.

18. A method of controlling the display of data represented as $H_d$ horizontal dots and $V_d$ vertical dots and having a predetermined number of dots defining a predetermined resolution on a display unit, comprising the steps of:

setting a first, predetermined maximum physically possible, display size for a display area for a display unit of $H_{max}$ horizontal dots by $V_{max}$ vertical dots in size, $H_{max}$ and $V_{max}$ being integer values;

setting a second display size to be used for displaying said data on said display unit in a logical display area, said second display size said first display size and having maximum values of $H_d$ horizontal dots by $V_d$ vertical dots in size, $H_d$ and $V_d$ being integer values and said logical display area is defined by said second display size;

generating blanking data;

setting predetermined horizontal and vertical display offset positions $H_m$ and $V_m$ as numbers of dots for said display data relative to ad desired starting position of said logical display area, wherein $0 \leqq H_m$ and $0 \leqq V_m$; and selectively outputting for display on said display unit one of (1) all of said display data in said logical display area of said display unit determined by starting at said vertical and horizontal offset positions and extending in area defined by $(H_m, V_m)$, $(H_m+H_d, V_m)$, $(H_m, V_m+V_d)$, $(H_m+H_d, V_m+V_d)$, said display data being displayed with the predetermined number of dots at the predetermined resolution, and (2) said generated blanking data in areas of said display unit outside said logical display area.

19. The method of claim 18 further comprising the steps of:

outputting said blanking data where the horizontal position ranges between 0 to $H_{max}$ when the vertical positions range between 0 to $V_m$ dots; outputting said blanking data where the horizontal position ranges between 0 to $H_m$ when the vertical positions range between $V_m$ and $(V_d+V_m)$ dots; and outputting said blanking data where the horizontal position ranges between $(H_m+H_d)$ and $H_{max}$ and the vertical between $V_m$ and $(V_d+V_m)$ dots, and outputting said blanking data where the horizontal position ranges between 0 and $H_{max}$ and the vertical positions between $(V_d+V_m)$ and $V_{max}$ dots, wherein $0 \leqq H_m$, $0 \leqq V_m$.

20. The method of claim 19 wherein $H_m$ ranges between 0 and a predetermined value less than or equal to $H_{max}-H_d$ and $V_m$ ranges between 0 and a predetermined value less than or equal to $V_{max}-V_d$.

21. The method of claim 19 wherein $H_m$ is equal to $(H_{max}-H_d)/2$.

22. The method of claim 19 wherein $V_m$ is equal to $(V_{max}-V_d)/2$.

23. A method of controlling display of data represented as $H_d$ horizontal dots and $V_d$ vertical dots and having a predetermined number of dots defining a predetermined resolution on a display unit having a fixed maximum display area, comprising the steps of:

setting a first predetermined maximum display size for a display area for the display unit of $H_{max}$ horizontal dots by $V_{max}$ vertical dots in size, $H_{max}$ and $V_{max}$ being integer values corresponding to the maximum physical display area;

setting a second display size for use in displaying data on said display unit, said second display size being less than said first display size and having maximum values of $H_d$ horizontal dots by $V_d$ vertical dots in size, with $H_d$ and $V_d$ being integer values;

storing data representative of the desired image in a buffer memory;

generating blanking data; and selectively retrieving and outputting one of (1) all of said stored display data to said display unit for display in the desired display area which is a portion of said first maximum display size as determined by the relationship of the number of horizontal and vertical dots for said first and second display sizes relative to each other, said display data being displayed with the predetermined number of dots at the predetermined resolution and (2) the blanking data in areas outside of said desired display area of said display unit.

24. A display controller for controlling the display of data represented as $H_d$ horizontal dots and $V_d$ vertical dots and having a predetermined number of dots defining a predetermined resolution on a display unit, comprising;

first input means for inputting a predetermined maximum usable first display size for the display unit corresponding to a maximum number of horizontal and vertical display dots that can be physically displayed thereon;

second input means for inputting a second display size to be used for displaying data as a desired number of horizontal and vertical dots, said second size being less than the predetermined maximum;

a buffer memory for storing image data to be displayed on said display unit;

a display counter having a count value that indicates display position on said display unit; and control means responsive to said first and second input means, and said buffer memory, for generating blanking data and for selectively outputting to said display unit one of (1) all of said display data in said buffer memory through application of address and read and write signals so as to display data covering said second display size in a desired display area of the display unit as defined by a relationship between the specified number of horizontal and vertical dots for said first and second display sizes relative to each other, said display data being displayed with the predetermined number of dots at the predetermined resolution, (2) the blanking data in accordance with the count value for display of said blanking data in a display portion outside of said desired display area.

25. A method of controlling the display of data represented as $H_d$ horizontal dots and $V_d$ vertical dots and having a predetermined number of dots defining a predetermined resolution on a display unit, comprising the steps of:

setting a first, predetermined maximum physically possible, display size for a display area for display unit of $H_{max}$ horizontal dots by $V_{max}$ vertical dots in size, $H_{max}$ and $V_{max}$ being integer values;

setting a second display size to be used for displaying said data on said display unit in a logical display area, said second display size being less than said first display size and having maximum values of $H_d$ horizontal dots by $V_d$ vertical dots in size, $H_d$ and $V_d$ being integer values and said logical display is defined by said second display size;

providing a buffer area having the size of $H_{max}$ by $V_{max}$ storage locations;

generating blanking data;

setting predetermined horizontal and vertical display offset positions $H_m$ and $V_m$ as numbers of dots for said display data relative to a desired starting position of said logical display area, wherein $0 \leqq H_m$, $0 \leqq V_m$;

storing the display data starting at the horizontal and vertical offset positioning $H_m$ and $V_m$; and selectively outputting for display on said display unit one of (1) all of said display data in said buffer area of said display unit determined by starting at said vertical and horizontal offset positions and extending in area defined by $(H_m, V_m)$, $(H_m+H_d, V_m)$, $(H_m, V_m+V_d)$ and $(H_m+H_d, V_m+V_d)$, said display data being displayed with the predetermined number of dots at the predetermined resolution; and (2) said generated blanking data in areas of said display unit other than the area defined by $(H_m, V_m)$, $(H_m+H_d, V_m)$, $(H_m, V_m+V_d)$ and $(H_m+H_d, V_m+V_d)$.

* * * * *

UNITED STATES PATENT AND TRADEMARK OFFICE

CERTIFICATE OF CORRECTION

PATENT NO. : 5,592,194

DATED : January 7, 1997

INVENTOR(S) : Fumitaka Nishikawa

It is certified that error appears in the above-indentified patent and that said Letters Patent is hereby corrected as shown below:

TITLE PAGE:

[30] Foreign Application Priority Data:

Please Insert --4/14/89 PCT PCT/JP89/00405--.

Column 6, line 24, before "predetermined" delete --.--.

line 25, change "of" to --on--.

line 65, after "display size" please insert --,--.

Column 8, line 45, change "1" to --11--.

Column 9, line 3, after "second display size" insert --being less than--.

Column 10, line 6, after "resolution" insert --;--.

Signed and Sealed this

Eighth Day of July, 1997

Bruce Lehman

*Attest:*

BRUCE LEHMAN

*Attesting Officer*

*Commissioner of Patents and Trademarks*